US008079879B2

(12) United States Patent
Chiang

(10) Patent No.: US 8,079,879 B2
(45) Date of Patent: Dec. 20, 2011

(54) RECEPTACLE CONNECTOR FOR DUAL SIGNAL TRANSMISSION PROTOCOL

(75) Inventor: Jui-Tu Chiang, Jhonghe (TW)

(73) Assignee: Taiwin Electronics Co., Ltd., Jhonghe, Taipei Hsien (TW)

( * ) Notice: Subject to any disclaimer, the term of this patent is extended or adjusted under 35 U.S.C. 154(b) by 215 days.

(21) Appl. No.: 12/497,619

(22) Filed: Jul. 3, 2009

(65) Prior Publication Data

US 2010/0015855 A1 Jan. 21, 2010

(30) Foreign Application Priority Data

Jul. 17, 2008 (TW) ..... 97212742 U

(51) Int. Cl.
*H01R 24/00* (2011.01)

(52) U.S. Cl. ..... 439/660

(58) Field of Classification Search ..... 439/638, 439/660, 722
See application file for complete search history.

(56) References Cited

U.S. PATENT DOCUMENTS

| | | | | |
|---|---|---|---|---|
| 7,517,253 | B1 * | 4/2009 | Chiang | 439/660 |
| 7,572,146 | B1 * | 8/2009 | Chiang | 439/607.01 |
| 2007/0173121 | A1 * | 7/2007 | Chiang | 439/609 |
| 2009/0111330 | A1 * | 4/2009 | Lin et al. | 439/638 |
| 2009/0298352 | A1 * | 12/2009 | Murakami | 439/682 |

* cited by examiner

*Primary Examiner* — Vanessa Girardi
(74) *Attorney, Agent, or Firm* — patenttm.us

(57) ABSTRACT

A receptacle connector has a housing, an eSATA terminal set, a first USB terminal set and a second USB terminal set. The housing has a socket space and a tongue formed in the socket space. The eSATA terminal set has eSATA terminals mounted on the tongue. The first USB terminal set has multiple first USB terminals mounted on the tongue opposite to the eSATA terminals for USB 2.0 signal transmission. The second USB terminal set has multiple second USB terminals mounted on the tongue opposite to the eSATA terminals for USB 3.0 signal transmission. The receptacle connector capable of providing eSATA, USB 2.0 or USB 3.0 signal transmission has high applicability.

4 Claims, 10 Drawing Sheets

RECEPTACLE CONNECTOR FOR DUAL SIGNAL TRANSMISSION PROTOCOL

BACKGROUND OF THE INVENTION

1. Field of the Invention

The present invention relates to a connector, and more particularly to a receptacle connector that may be connected to plug connectors of different signal transmission protocols and run at full speed.

2. Description of Related Art

The electronic and network technologies develop fast for facilitating human life and thus make electronic devices popular in people's daily life. Data transmission between electronic devices is implemented by socket connectors thereon and corresponding plug connectors on cables connected to the electronic devices. Universal Serial Bus (USB) and External Serial ATA (eSATA) protocols are most common two that connectors employ.

Taiwan Utility Patent No. M293552 discloses a socket connector for eSATA and USB transmission protocols and having a housing, a terminal seat, multiple USB terminals and multiple eSATA terminals. The USB terminals comply with the USB 2.0 protocol. The eSATA terminals comply with the eSATA protocol. Therefore, the socket connector may be connected to plug connectors of different protocols.

A new USB 3.0 protocol has been developed to have signal transmission speed of 4.8 Gbps that is much higher when compared to USB 2.0 protocol. However, terminals of a standard USB 3.0 plug or receptacle connector are more than those of the USB 2.0 plug or receptacle connector. When a USB 3.0 plug connector is connected to a USB 2.0 receptacle connector, the several terminals of the USB 3.0 plug connector idle to lower the signal transmission speed.

To overcome the shortcomings, the present invention provides a receptacle connector to mitigate or obviate the aforementioned problems.

SUMMARY OF THE INVENTION

The main objective of the invention is to provide a receptacle connector that may be connected to plug connectors of different signal transmission protocols and run at full speed.

A receptacle connector in accordance with the present invention has a housing, an eSATA terminal set, a first USB terminal set and a second USB terminal set. The housing has a socket space and a tongue formed in the socket space. The eSATA terminal set has eSATA terminals mounted on the tongue. The first USB terminal set has multiple first USB terminals mounted on the tongue opposite to the eSATA terminals for USB 2.0 signal transmission. The second USB terminal set has multiple second USB terminals mounted on the tongue opposite to the eSATA terminals for USB 3.0 signal transmission.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
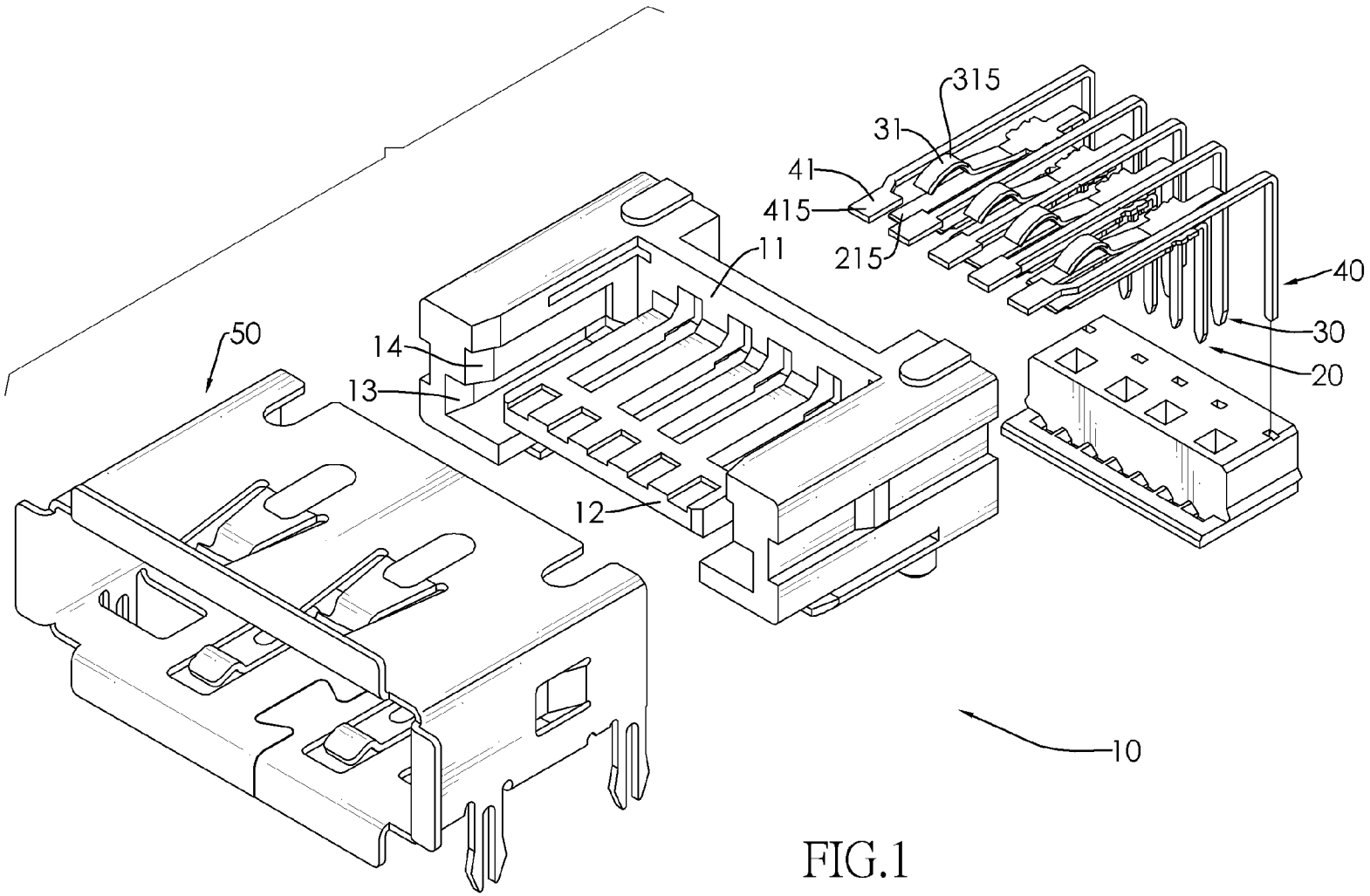
FIG. 1 is an exploded perspective view of a first embodiment of a receptacle connector in accordance with the present invention.
Figure 2:
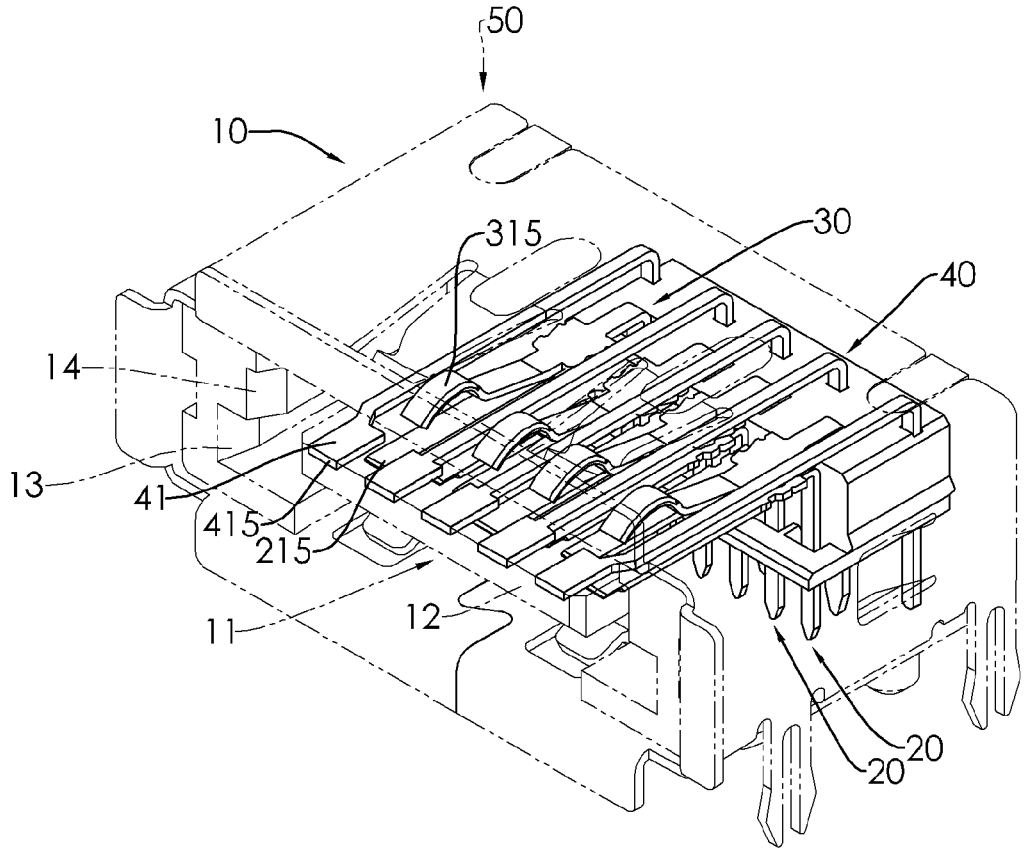
FIG. 2 is a perspective view of the receptacle connector in FIG. 1.
Figure 3:
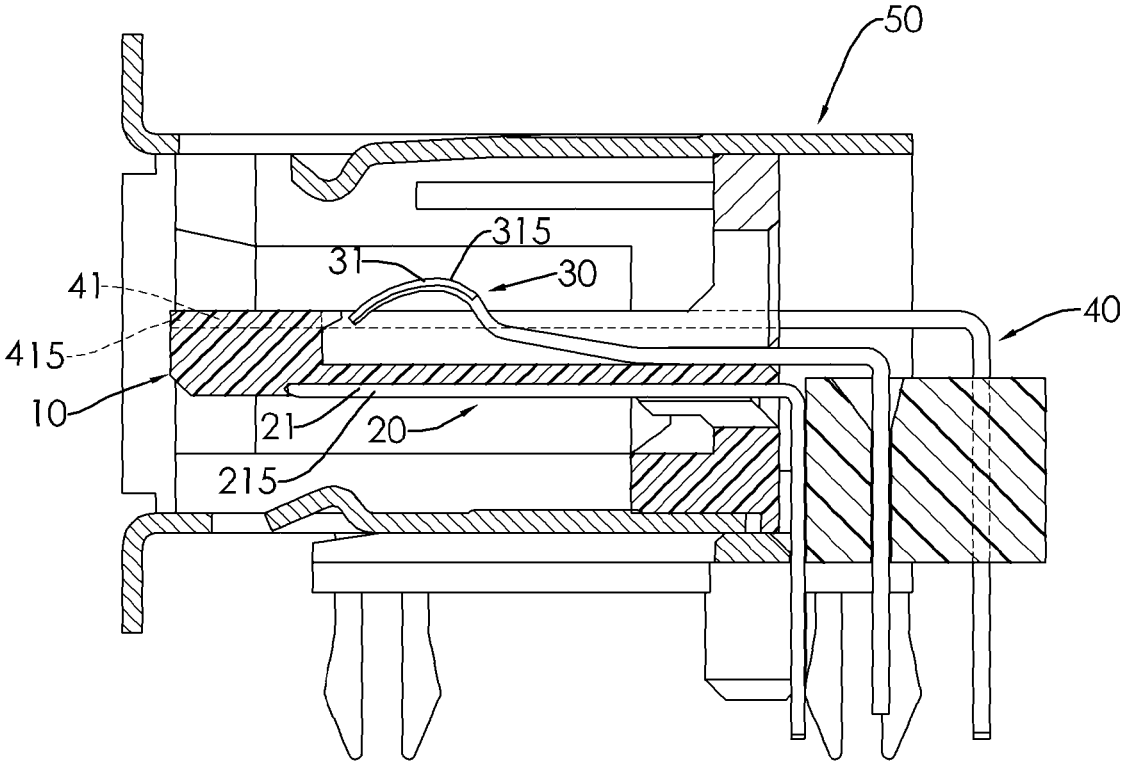
FIG. 3 is a side view in partial section of the receptacle connector in FIG. 2.

With reference to FIGS. 1 to 3, a first embodiment of the a receptacle connector in accordance with the present invention comprises a housing, an eSATA terminal set (20), a first USB terminal set (30) and a second USB terminal set (40).

The housing has an insulative base (10) and a metal shell (50).

The insulative base (10) has a socket space (11), a tongue (12), an eSATA plug outline (13) and a USB plug outline (14).

The socket space (11) is defined in the insulative base (10) of the housing, may accommodate a corresponding plug connector and has an inner surface and two opposite side surfaces. The side surfaces are symmetrical and stepped.

The tongue (12) is formed on and protrudes forwards from the inner surface of the socket space (11) and has two opposite mounting surfaces. The mounting surfaces may be a top mounting surface and a bottom mounting surface.

The eSATA plug outline (13) is defined on the stepped side surfaces and corresponds to an outline of a standard eSATA plug connector for foolproof purposes.

The USB plug outline (14) is defined on the stepped side surfaces and corresponds to an outline of a standard USB 2.0 or 3.0 plug connector for foolproof purposes.

The metal shell (50) is hollow and covers the insulative base (10) to define an opening communicating with the socket space (11) and allowing an eSATA or USB plug connector to extend through the opening into the socket space (11).

The eSATA terminal set (20) is mounted securely on one mounting surface of the tongue (12) and has multiple eSATA terminals (21). The eSATA terminals (21) may be seven and may respectively contact terminals of an eSATA plug connector for eSATA signal transmission.

Each eSATA terminal (21) has a mounting section, a soldering section and a contacting section (215). The mounting section is mounted on the tongue (12). The soldering section is formed on and protrudes perpendicularly from the mounting section and may be soldered on a printed circuit board (PCB). The contacting section (215) is formed on and protrudes forwards from the mounting section for electrical connection and is mounted on one mounting surface of the tongue (12).

The first USB terminal set (30) is mounted securely on the other mounting surface of the tongue (12) opposite to the eSATA terminal set (20) and has multiple first USB terminals (31). The first USB terminals (31) may be four and may respectively contact terminals of a USB 2.0 plug connector for USB 2.0 signal transmission.

The second USB terminal set (40) is mounted securely on the mounting surface of the tongue (12) opposite to the eSATA terminal set (20) and has multiple second USB terminals (41). The second USB terminals (41) may be five and may cooperate with the first USB terminals (31) to respectively contact nine terminals of a USB 3.0 plug connector for USB 3.0 signal transmission.

Each of the first and second USB terminals (31, 41) has a mounting section, a soldering section and a contacting section (315, 415). The mounting section is mounted on the tongue (12). The soldering section is formed on and protrudes perpendicularly from the mounting section and may be soldered on the PCB. The contacting section (315, 415) is formed on and protrudes forwards from the mounting section for electrical connection and is mounted on the other mounting surface of the tongue (12).

In a preferred embodiment, the eSATA terminal set (20) is mounted securely on the bottom mounting surface of the tongue (12). The first and second USB terminal sets (30, 40) are mounted securely on the top mounting surface of the tongue (12) opposite to the eSATA terminal set (20).

Figure 4:
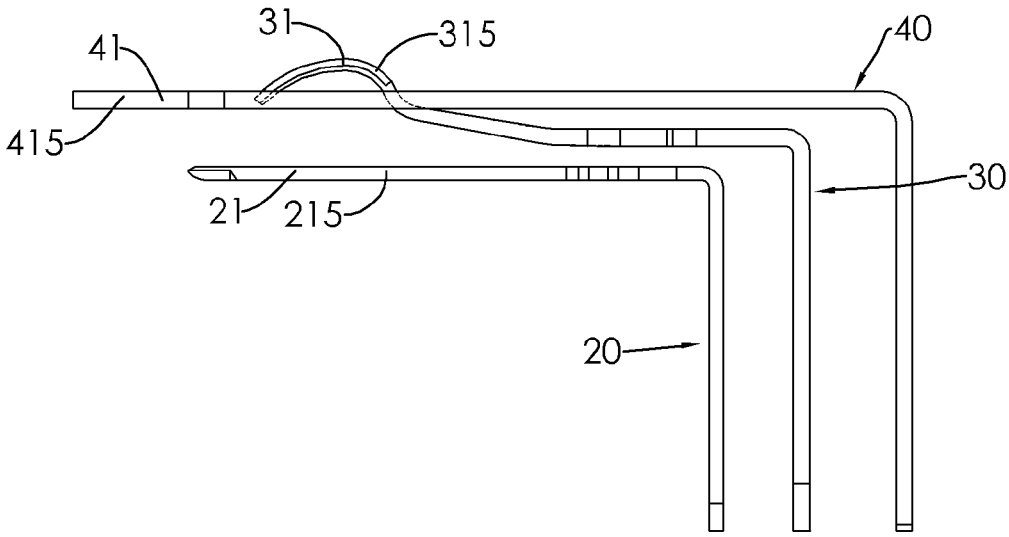
FIG. 4 is a side view of the eSATA, first USB and second USB terminals of the receptacle connector in FIG. 2.
Figure 4A:
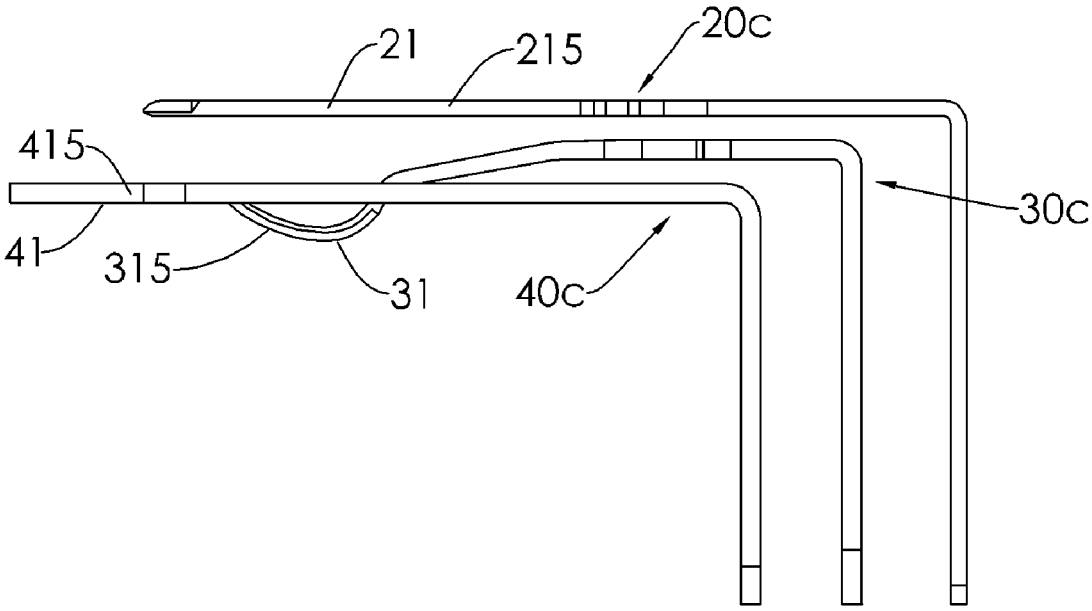
FIG. 4*a* is a side view of the eSATA, first USB and second USB terminals of a variant embodiment of a receptacle connector in accordance with the present invention.
Figure 5:
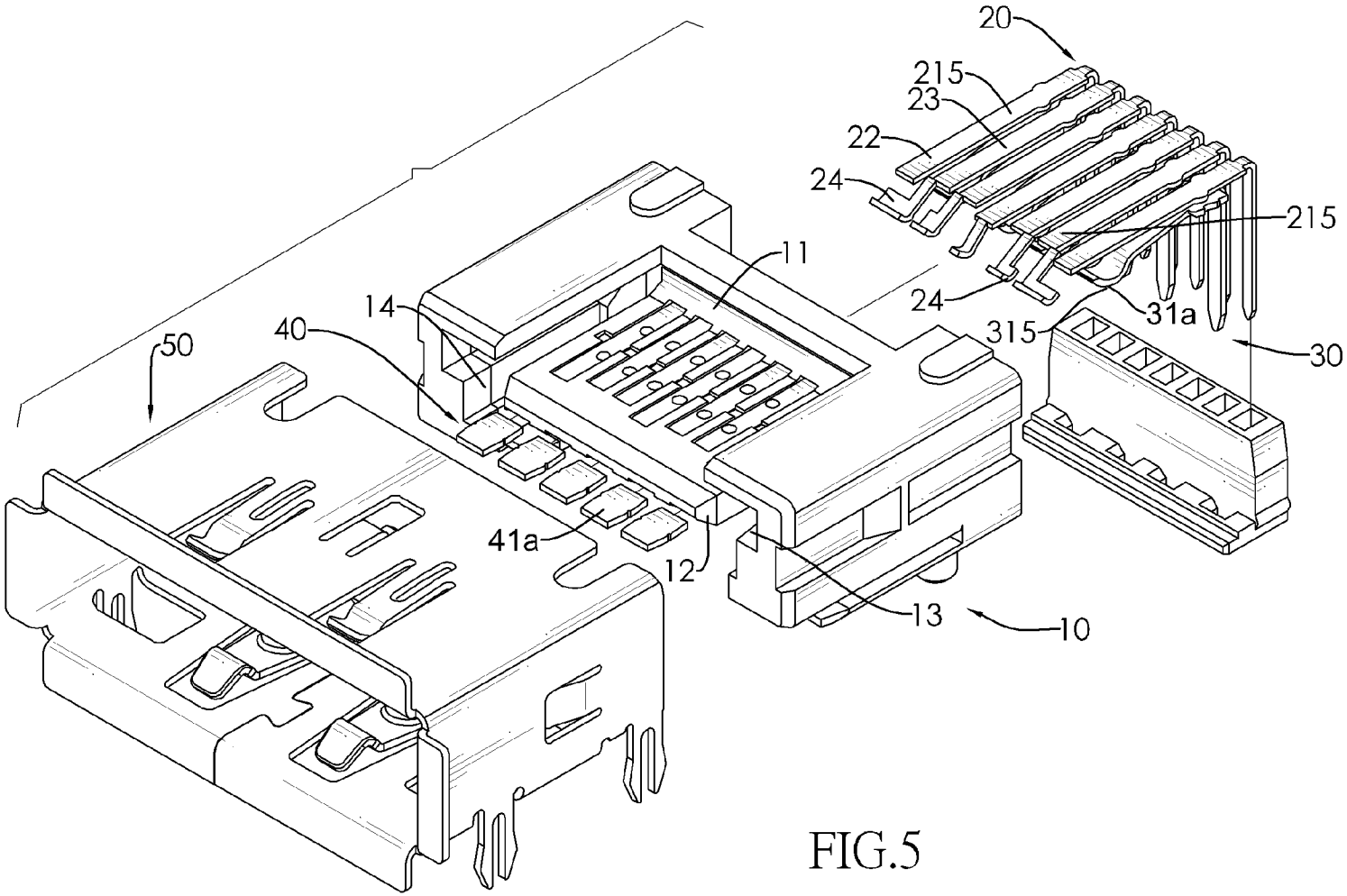
FIG. 5 is an exploded perspective view of a second embodiment of a receptacle connector in accordance with the present invention.
Figure 6:
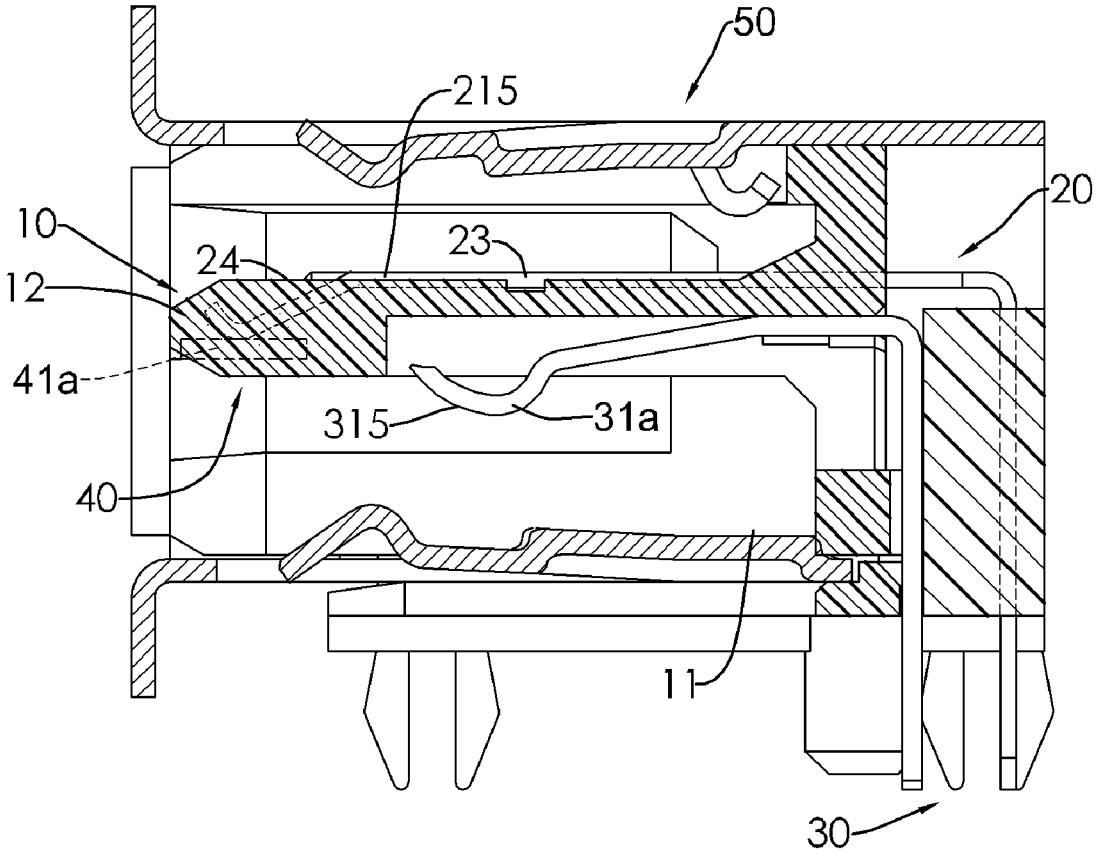
FIG. 6 is a side view in partial section of the receptacle connector in FIG. 5.
Figure 7:
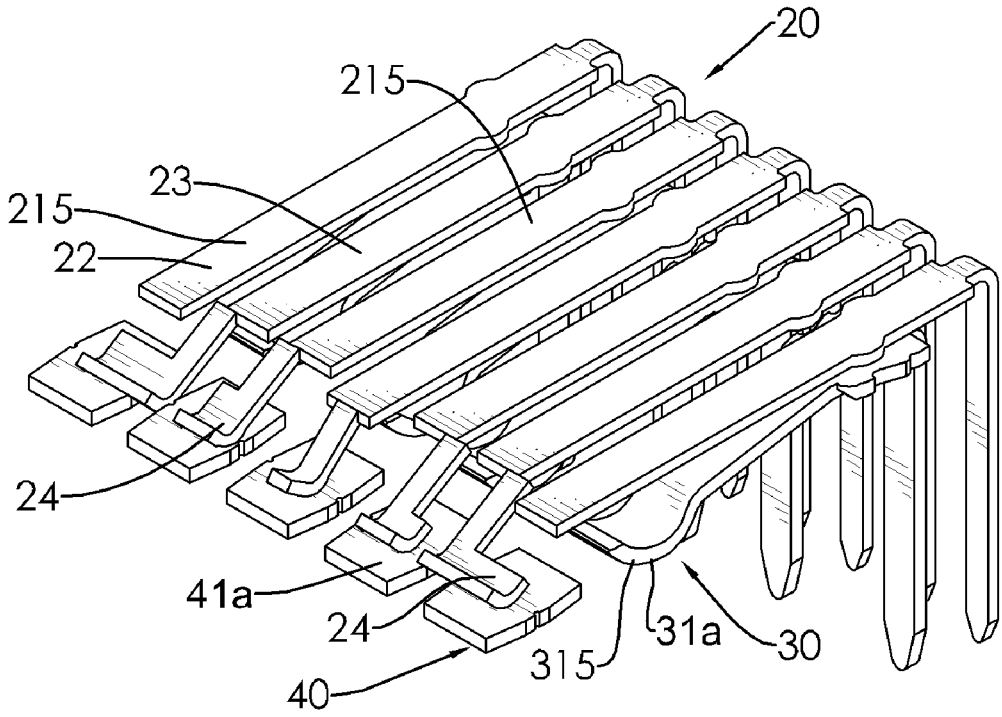
FIG. 7 is an enlarged perspective view of the eSATA, first USB and second USB terminals of the receptacle connector in FIG. 5.

With further reference to FIG. 4*a*, a variant embodiment of a receptacle connector in accordance with the present invention is similar to the first embodiment. However a vertical arrangement of the eSATA terminal set (20*c*) and the first and second USB terminal set (30*c*, 40*c*) of the current embodiment is reversed relative to the housing when compared to the first embodiment. The eSATA terminals (21) are mounted on the top mounting surface of the tongue (12) of the insulative base (10). The first and second USB terminals (31, 41) are mounted in the bottom mounting surface of the tongue (12).

With reference to FIGS. 5 to 8, a second embodiment of a receptacle connector in accordance with the present invention is similar to the first embodiment. However the eSATA terminals of the eSATA terminal set (20) are mounted on the top mounting surface of the tongue (20) of the insulative base (10) and are classified into multiple first eSATA terminals (22) and multiple second eSATA terminals (23). Each second eSATA terminal (23) may have a connecting section (24). The connecting section (24) is connected to the second eSATA terminal (23), may be mounted securely on the tongue (12), may be located near the opening defined by the insulative base (10) and the metal shell (50) and may be formed on and protrude from the contacting section (215) of the second eSATA terminal (23).

The first USB terminals (31*a*) of the first USB terminal set (30) are mounted on the bottom mounting surface of the insulative base (10).

The second USB terminals (41*a*) of the second USB terminal set (40) may be pieces without soldering sections, are mounted detachably on the bottom mounting surface of the tongue (12) of the insulative base (10) and correspond respectively to and are connected respectively to the second eSATA terminals (23). The second USB terminals (41*a*) may be located near the opening defined by the insulative base (10) and the metal shell (50) and may be connected respectively to the connecting sections (24) of the second eSATA terminals (23).

The receptacle connector of the present invention provides eSATA, USB 2.0 and USB 3.0 signal transmission protocols. When an eSATA plug connector is connected to the receptacle connector, the outline of the eSATA plug connector is aligned with the eSATA plug outline (13) of the insulative base (10). Furthermore, the terminals of the eSATA plug connector respectively contact the eSATA terminals (21, 22, 23). When a USB 2.0 plug connector is connected to the receptacle connector, the outline of the USB 2.0 plug connector is aligned with the USB plug outline (14) of the receptacle connector. Furthermore, the terminals of the USB 2.0 plug connector respectively contact the first USB terminals (31, 31*a*). When a USB 3.0 plug connector is connected to the receptacle connector, the outline of the USB 3.0 plug connector is aligned with the USB plug outline (14) of the receptacle connector. Furthermore, the terminals of the USB 3.0 plug connector respectively contact the first and second USB terminals (31, 31*a*, 41, 41*a*).

Figure 8:
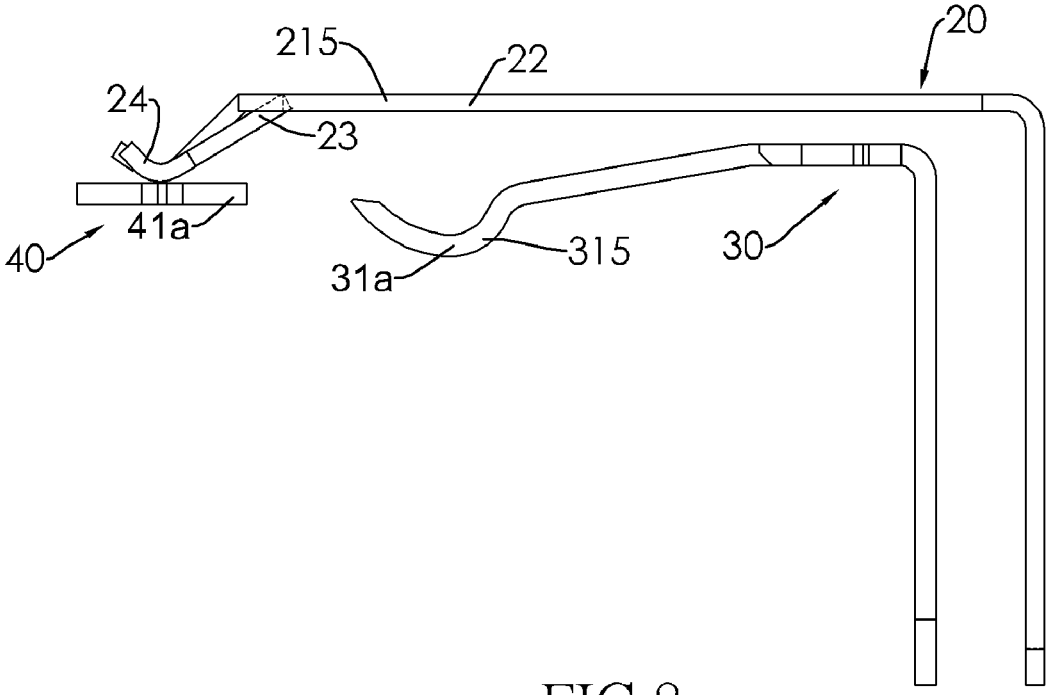
FIG. 8 is a side view of the eSATA, first USB and second USB terminals of the receptacle connector in FIG. 7.
Figure 8A:
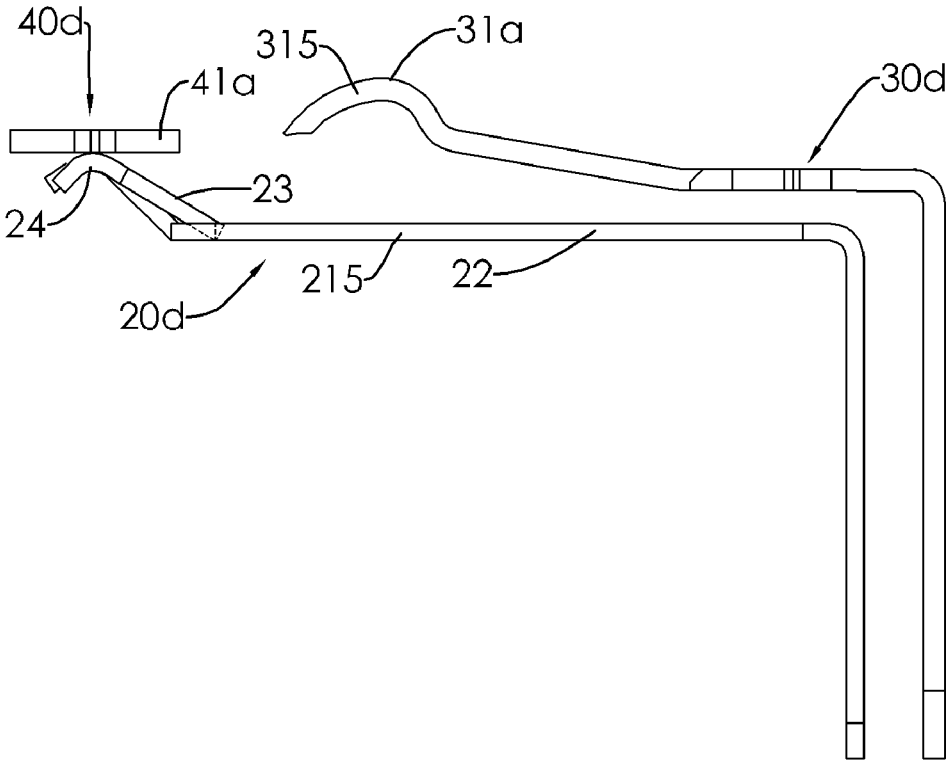
FIG. 8*a* is a side view of the eSATA, first USB and second USB terminals of a variant embodiment of a receptacle connector in accordance with the present invention.

With further reference to FIG. 8*a*, a variant embodiment of a receptacle connector in accordance with the present invention is similar to the second embodiment. However a vertical arrangement of the eSATA terminal set (20*d*) and the first and second USB terminal set (30*d*, 40*d*) of the current embodiment is reversed relative to the housing when compared to the second embodiment. The first and second eSATA terminals (22, 23) are mounted on the bottom mounting surface of the tongue (12) of the insulative base (10). The first and second USB terminals (31*a*, 41*a*) are mounted in the top mounting surface of the tongue (12).

The receptacle connector capable of providing connection to the eSATA, USB 2.0 or USB 3.0 plug connector has high applicability. Furthermore, the receptacle connector with the first and second USB terminals (30, 40) allows the connected USB 3.0 plug connector to run under full signal transmission speed.

Even though numerous characteristics and advantages of the present invention have been set forth in the foregoing description, together with details of the structure and function of the invention, the disclosure is illustrative only Changes may be made in the details, especially in matters of shape, size, and arrangement of parts within the principles of the invention to the full extent indicated by the broad general meaning of the terms in which the appended claims are expressed.

What is claimed is:

1. A receptacle connector comprising:

a housing having a socket space defined in the housing; and a tongue formed in the socket space; and an opening defined in the housing;

an eSATA terminal set mounted on the tongue and having multiple eSATA terminals for eSATA signal transmission;

a first USB terminal set mounted on the tongue opposite to the eSATA terminal set and having multiple first USB terminals for USB 2.0 signal transmission; and a second USB terminal set mounted on the tongue and having multiple second USB terminals for USB 3.0 signal transmission; wherein the second USB terminals are mounted detachably on the tongue and are located near the opening.

2. The receptacle connector as claimed in claim 1, wherein the housing has an eSATA plug outline adapted to correspond to an outline of an eSATA plug connector; and a USB plug outline adapted to correspond to an outline of a USB plug connector.

3. The receptacle connector as claimed in claim 1, wherein the eSATA are classified into multiple first eSATA terminals and multiple second eSATA terminals, and each second eSATA terminal has a connecting section; and the second USB terminals correspond respectively to and are connected respectively to the connecting sections of the second eSATA terminals.

4. The receptacle connector as claimed in claim 3, wherein the housing has an eSATA plug outline adapted to correspond to an outline of an eSATA plug connector; and a USB plug outline adapted to correspond to an outline of a USB plug connector.

* * * * *